US005900118A

United States Patent [19]

Breiten

[11] Patent Number: 5,900,118

[45] Date of Patent: May 4, 1999

[54] CLOSED SHOE PRESS HEAD INDEXING SYSTEM

[75] Inventor: John D. Breiten, So. Beloit, Ill.

[73] Assignee: Beloit Technologies, Inc., Wilmington, Del.

[21] Appl. No.: 09/005,000

[22] Filed: Jan. 9, 1998

Related U.S. Application Data

[62] Division of application No. 08/691,044, Aug. 1, 1996, Pat. No. 5,733,415.

[51] Int. Cl.[6] ..... D21F 3/08

[52] U.S. Cl. ..... 162/199; 162/205; 162/272

[58] Field of Search ..... 162/199, 205, 162/272, 256, 257, 358.3, 361

[56] References Cited

U.S. PATENT DOCUMENTS 5,084,137 1/1992 Ilmarinen et al. ..... 162/272

5,643,416 7/1997 Lange et al. ..... 162/199

*Primary Examiner*—Karen M. Hastings

*Attorney, Agent, or Firm*—Raymond W. Campbell; Gerald A. Mathews

[57] ABSTRACT

A blanket passes over a concave shoe which is urged against a backing roll to form a press nip. The ends of the blanket are attached to circular heads. The transition from the nip-imposed cardioid shaped to the circular shape maintained by the heads results in a region of the blanket subject to fatigue. The heads are mounted on journals for motion between inboard stops and outboard stops which are spaced apart approximately 4 inches in the cross machine direction. Positioning of the heads on the journals is controlled by four hydraulic pistons mounted between the support beam and each head. Multiple hydraulic systems are controlled to extend the life of the blanket by alternating between holding the back head fixed and letting the front head float and fixing the front head and letting the back head float.

3 Claims, 4 Drawing Sheets

CLOSED SHOE PRESS HEAD INDEXING SYSTEM

RELATED APPLICATION

This application is a divisional of U.S. Ser. No. 08/691,044, filed Aug. 1, 1996, now U.S. Pat. No. 5,733,415.

FIELD OF THE INVENTION

The present invention relates to presses used in papermaking machines in general and to presses employing a shoe to form a nip with a backing roll in particular.

BACKGROUND OF THE INVENTION

The art and science of the design of papermaking machines have made significant advances in the last twenty years. The direction of these improvements has been towards increased efficiency in the manufacture of paper by increasing the speed at which the web is formed and by increasing the width of the web. With increased machine speed there is a need—particularly in the pressing section of a papermaking machine—to increase the time the paper takes in moving through press nips. This is most effectively accomplished by utilizing a shoe with a concave surface opposite a backing roll. In order for the web to move through the nip without frictional resistance a blanket is passed over the shoe. The blanket is lubricated and cooled by a supply of oil or other lubricant which is forced between the blanket and the shoe. One type of press utilizing a shoe is the so called open Extended Nip® press of the type manufactured by Beloit Corporation of Beloit, Wis. In this type of press, the lubricating blanket is supported on a plurality of support rolls which direct the blanket through the nip between the backing roll and the shoe in a way similar to the way in which conventional felts are directed.

In some circumstances open Extended Nip presses result in leakage of oil onto the felts and the web as they transit the nip. In other circumstances it is desirable to place the shoe above the backing roll. In this position the lubricating oil has a tendency to drain down onto the web being pressed. This has led to the development of the so called closed Extended Nip press. A closed Extended Nip press has a blanket the ends of which are extended beyond the nip and the shoe and sealed to a circular head. Sealing the ends of the blanket solves the problem of lubricant leakage. As the blanket moves through the nip it forms a cardioid shape as the circular blanket is deformed between the shoe and the backing roll. Thus the blanket transitions from a cardioid shape at the nip to the circular shape required by the mounting to the heads which contain the lubricant. The transition region of the blanket between the cardioid shape and the circular shape rotates as the blanket rotates through the nip. The repeated flexure of the blanket eventually causes the blanket material to fail. This failure of the blanket can be a significant source of maintenance down time, which, owing to the high capital investment in a papermaking machine, is a significant contributor to costs in the production of paper.

The motion of the blanket through a closed Extended Nip press results in a gradual lengthening of the blanket in the cross machine direction. In a typical Extended Nip press one head or end of the blanket is held fixed and the other is allowed to float. The free end is thus able to move laterally to accommodate the growth in the blanket. A gradual lengthening of the blanket takes place throughout the portion of the blanket which passes through the nip. Thus the end of the blanket which is held fixed experiences little or no lengthening, and the region of the blanket which is fatigued by the transition between the circular end heads and the cardioid shape remains fixed with respect to the shoe.

One approach to achieving a longer life of the closed nip blanket is to move the fixed side of the blanket by, for example, moving the position of the fixed side of the blanket. One known approach is to install spacers against a fixed stop thus moving the fixed end of the blanket so the fatigue-stressed region is shifted with respect to the fixed end. The difficulty of adding and moving spacers makes this approach less than completely satisfactory.

What is needed is a method and apparatus for extending the life of a blanket in an Extended Nip press.

SUMMARY OF THE INVENTION

The Extended Nip-type press of this invention employs a blanket which passes over a shoe which is urged against a backing roll to form a press nip. The blanket is lubricated by a film of lubricant which cools and lubricates the shoe and blanket. The ends of the blanket are attached to circular back and front heads which are mounted for rotation on the ends or journals of a support beam. The support beam supports the shoe and the hydraulic piston which presses the shoe against the backing roll. The blanket extends past the ends of the shoe in the cross machine direction. The extensions of the blanket beyond the shoe are attached to the circular heads. The blanket takes on a cardioid shape as it moves through the nip. The transition from the nip-imposed cardioid shape to the circular shape maintained by the heads subjects a region of the blanket to fatigue. The heads are mounted on the journals for motion between inboard stops and outboard stops which are spaced apart approximately 4 inches in the cross machine direction. Positioning of the heads on the journals is controlled by four hydraulic pistons mounted between the support beam and each head. The hydraulic pistons are connected to a hydraulic control system and can be switched between a system that fixes a particular head against a stop, and a hydraulic system which allows the head to freely move along the journal while maintaining a selected tension on the head which is free to move.

As the blanket passes through the nip formed by the shoe and the backing roll the blanket is repeatedly compressed in the nip. This compression results in a growth in the machine-direction length of the blanket. The motion of the heads on the journals provides room for the blanket to increase in length by about eight inches. The regions of the blanket subjected to fatigue are located a fixed distance from the ends of the shoe. The life of the blanket is maximized by alternating between holding the back head fixed and letting the front head float, and fixing the front head and letting the back head float. The blanket starts out with a length which extends between the front and back inboard stops. One of the heads is held against its inboard stop and the other head is allowed to float. Periodically the hydraulic systems connected to the front head and the back head are reversed so that the head which was fixed against the inboard stop is allowed to move freely and the formerly free head is then held against its inboard stop.

When the blanket has grown by an amount approximately equal to the distance between the inboard and outboard stops, for example four inches, the head being held fixed is held against an intermediate stop between the inboard and outboard stops. The intermediate stop is required because if the blanket is allowed to grow the full distance between one inboard stop and its outboard stop the blanket may lose the required cross machine direction tension as the free head bottoms out against the free end outboard stop. In the same way if the fixed head is moved against the outboard stop when the blanket has not grown at least four inches or the distance between the inboard and outboard stops, the blanket will be over-tensioned in the cross machine direction. Once the blanket has been allowed to grow in the cross machine direction by more than four inches the hydraulic systems may be used to alternate the head which is held fixed against the outboard stops until the entire expansion distance of eight inches has been used up. At that point the blanket is trimmed by up to eight inches and the process is started again.

It is a feature of the present invention to provide a means for increasing the life of a blanket in a closed press employing a concave shoe and a backing roll.

It is another feature of the present invention to provide a press for a papermaking machine in which the press is of the type employing a concave shoe against a backing roll with lower maintenance requirements.

It is a further feature of the present invention to provide a method of operating a press for a papermaking machine of the type employing a concave shoe against a backing roll and using a blanket which is sealed, the method of operating expanding the life of the blanket.

Further objects, features and advantages of the invention will be apparent from the following detailed description when taken in conjunction with the accompanying drawings.

DESCRIPTION OF THE PREFERRED EMBODIMENT

Figure 1:
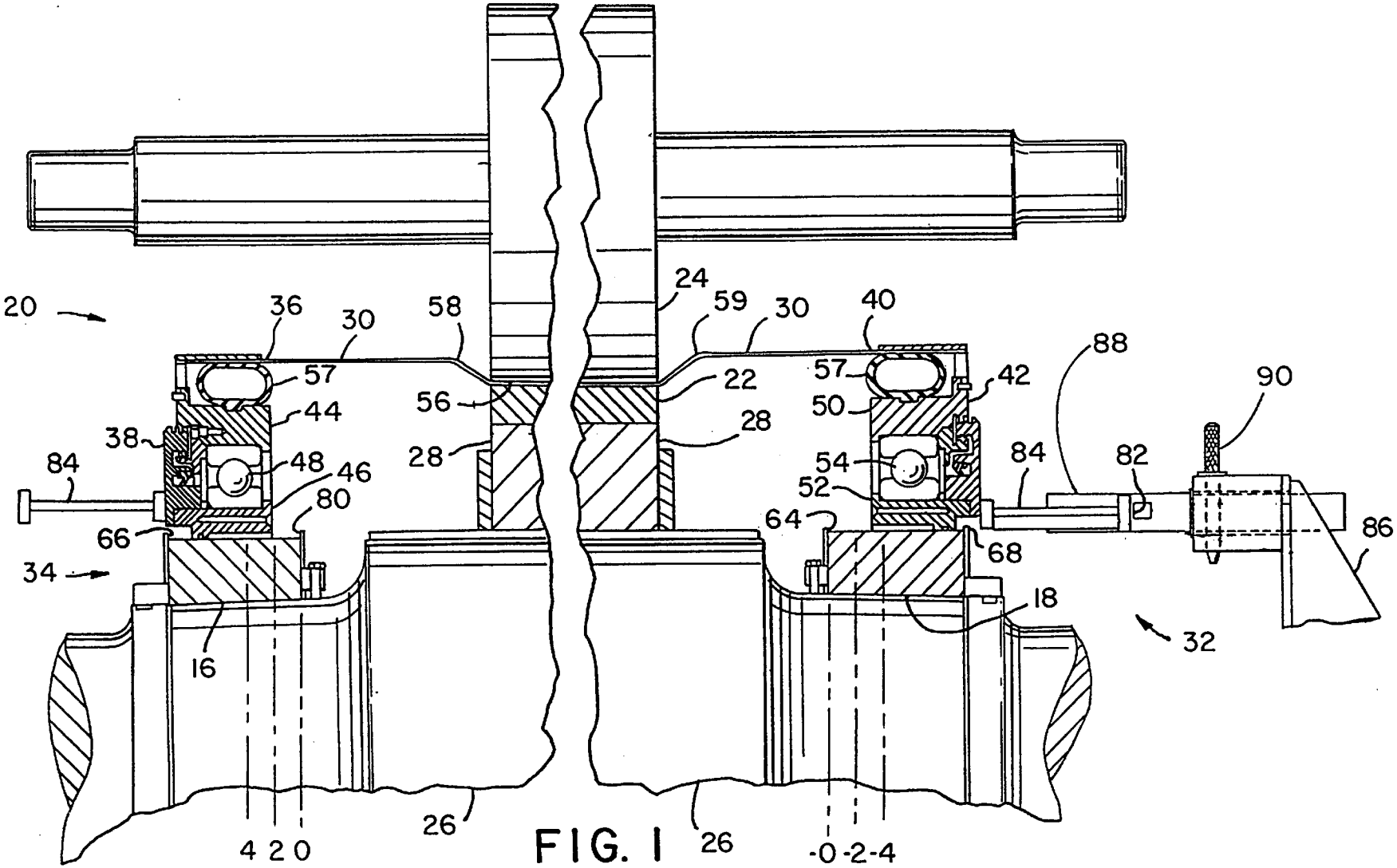
FIG. 1 is a schematic elevational cross-sectional view of the apparatus of this invention having a press formed between a backing roll and a concave shoe employing a closed blanket surrounding the shoe.

Referring more particularly to FIGS. 1–4 wherein like numbers refer to similar parts, a press 20 formed by a shoe 22 and a backing roll 24 is shown in FIG. 1. The shoe 22 is supported on a cross beam 26 by one or more hydraulic pistons 28 which urge the shoe 22 against the backing roll 24. A film of oil or lubricating fluid is supplied between a blanket 30 and the shoe 22 allowing the blanket 30 to move over the shoe with low friction. The press 20 has a back end 32 and a front end 34. The blanket 30 front end 36 is mounted to a front head 38, and the blanket back end 40 is mounted to a back head 42. The front head 38 is divided into a front rotating portion 44 and a front sliding portion 46 which are joined by a bearing 48. The front head 38 is mounted by the sliding portion 46 to a front journal 16 which extends from the cross beam 26. The back head 42 is similarly divided into a rotating portion 50 and a back sliding portion 52 which are joined by a bearing 54. The back head 42 sliding portion 52 travels on the back journal 18 which extends from the cross beam 26.

In operation the blanket 30 rotates on the bearings 48, 54 so the blanket 30 passes through a nip 56 formed between the backing roll 24 and the shoe 22. The blanket moves at a velocity matching that of the roll 24 with which it is in contact. The blanket 30 is a flexible sheet and can easily be bent without deformation in a single plane. Stated another way, a flexible sheet can easily be bent in the shape of a conic-section or a series of conic-sections. Such shapes are also known as developable surfaces. The shape of the blanket 30 as it moves through the nip is somewhat cardioid in shape and this shape is developable. The cylindrical ends 36, 40 of the blanket 30 are clamped by toroidal bladders 57 to the heads 38, 42. However, the transition between the cardioid shape and the clamped cylindrical ends 36, 40 of the blanket 30 causes bending in two planes simultaneously. These areas or regions 58, 59 of biplanar bending are subject to considerable deformation which results in a concentrated region of blanket fatigue. There are two highly fatigued areas on either side of the nip 56, a front region 58 and a back region 59. The regions 58, 59 are the portions of the blanket 30 in which blanket failure originates.

Figure 2:
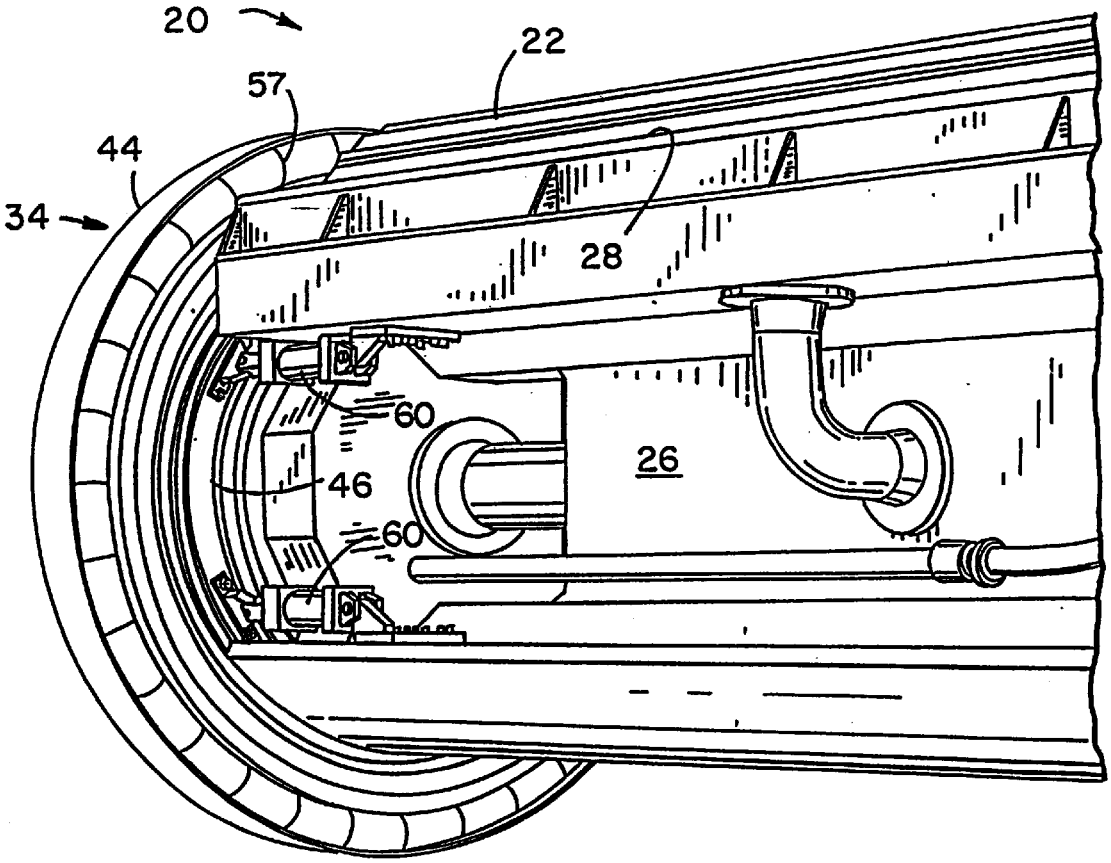
FIG. 2 is an isometric view of the press of FIG. 1.

At the same time the blanket 30 is being fatigued it is also being subjected to squeezing as it passes through the nip 56. This squeezing or compression causes the blanket to grow in machine direction length. For the blanket 30 to function it must be kept under tension in the machine direction. The tension of the blanket 30 is accomplished by inflating the blanket 30 with between zero and two psi of air pressure typically one psi. As shown in FIG. 2, the blanket 30 is also tensioned by four hydraulic pistons 60 mounted between the stationery cross beam 26 and the front head 38. Similar pistons are mounted between the cross beam 26 and the back head 42.

In existing machines one end—typically the back end—is held fixed and the front end is allowed to float free so that tension in the blanket remains constant as the blanket grows in length in the machine direction. The back head in existing machines is held by four hydraulic pistons in one of two positions. The back head has been held against an inboard stop 64 or, when the blanket has grown such that the front end head approaches the front outboard stop, the back head has been held against the back head outboard stop. This results in the region of high fatigue adjacent to the back head assuming one of two positions, relative to the blanket back end. One known approach to varying the fatigue region is to add spacers to the back head to vary the position of the region of high fatigue adjacent to the back head. However, adding spacers requires down time.

Typically where a two-position system for positioning the back head is used a single one-half-inch spacer is positioned against the outboard stop 68 so the back head 42 can be moved from the inboard stop 64 to the outboard stop 68 before the 30 blanket has stretched the entire length between inboard and outboard stops. The distance between inboard and outboard stops on a typical machine is four inches.

The improved press 20 of this invention, as shown in FIG. 1 significantly lengthens the life of the blanket 30 by switching back-and-forth between which of the heads 42, 34 is held fixed and which is allowed to float.

Figure 4:
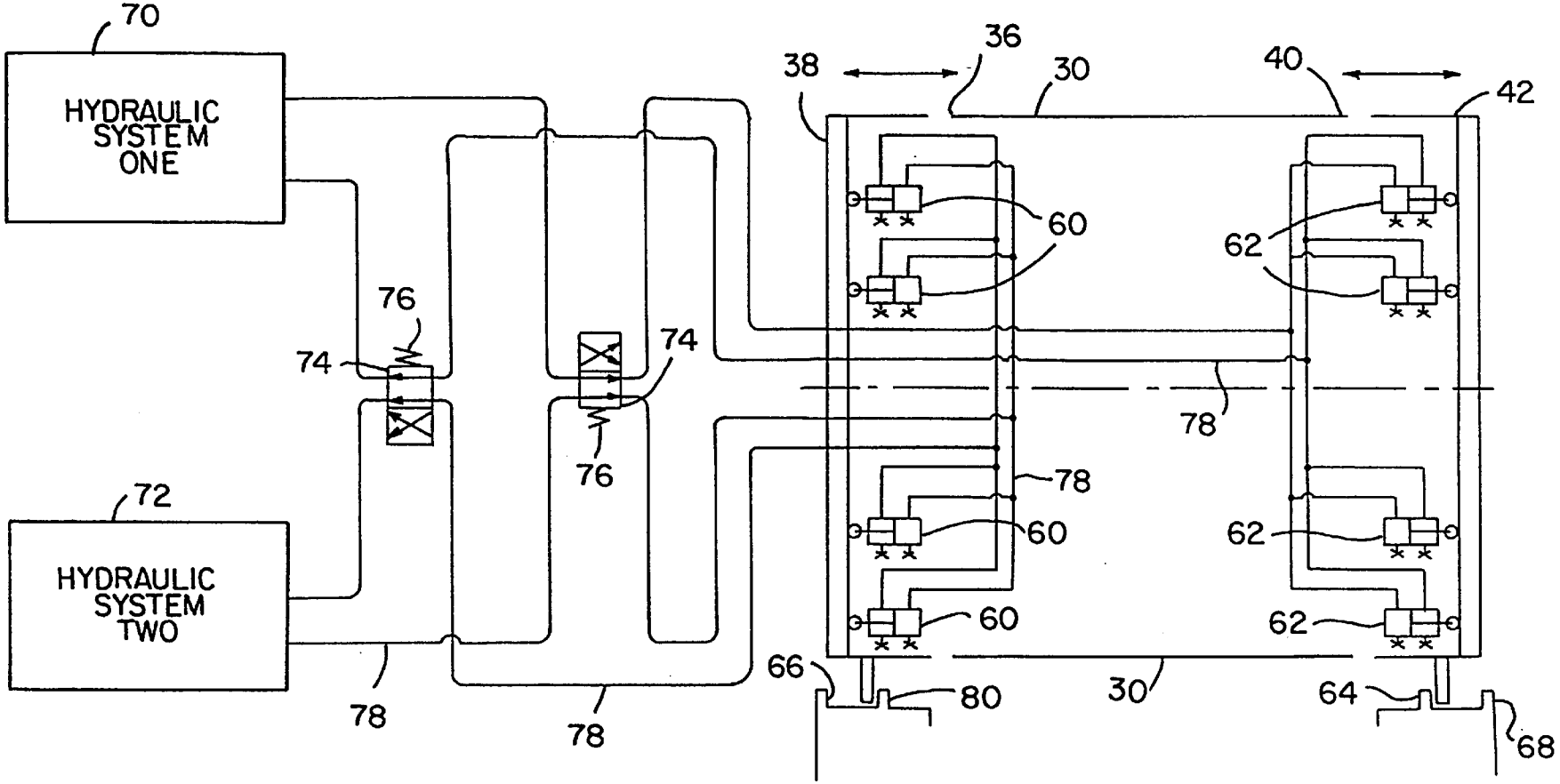
FIG. 4 is a schematic diagram of the hydraulic systems used for positioning the press blanket of FIG. 1.

As shown in FIG. 4, a first hydraulic system 70 is designed to operate hydraulic pistons 60 or 62 to hold a head 42 or 34 against a stop and thereby maintain a constant position. A second hydraulic system 72 is designed to supply a fixed level of tension to the blanket 30 by pushing against the free floating head. The second system applies a constant load. Hydraulic switches 74 actuated by solenoids 76 are positioned in the supply lines 78 which supply hydraulic fluid to actuate the pistons 60, 62.

Figure 3:
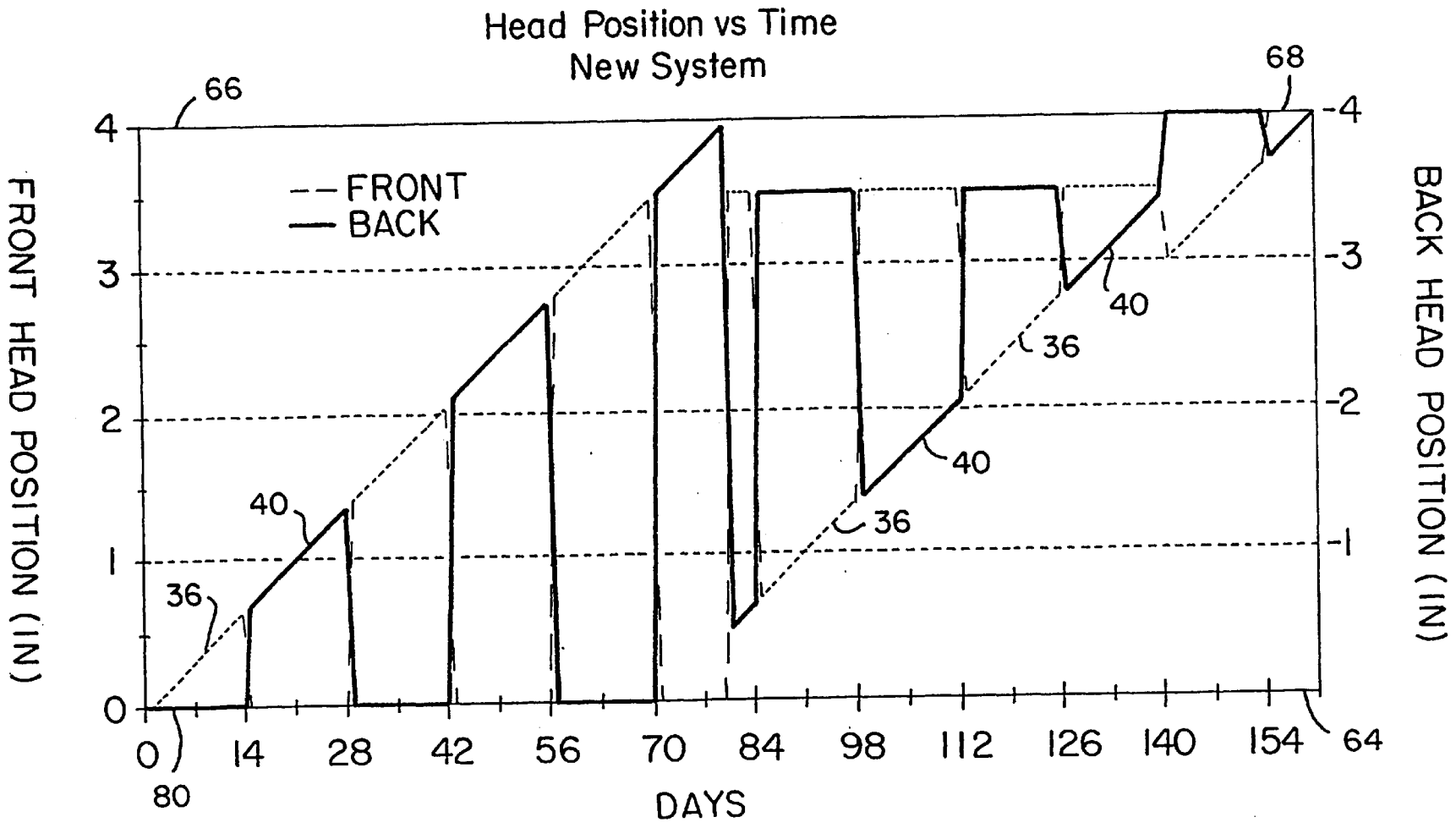
FIG. 3 is a graphical view of the position of the ends of the press blanket of FIG. 1 over time in accordance with the method of operating the press of FIG. 1.

In operation the back head 42 is held fixed when first a new blanket 30 is installed on the machine 20. The back head 42 is held against the inboard stop 64 as shown in FIG. 3 for fourteen days until the blanket 30 has grown approximately one-half inch. At day fourteen the hydraulic systems 70, 72 are switched so the front head 38 is now held fixed against the front inboard stop 80. This process is continued with the fixed head and the free floating head being reversed every fourteen days until the blanket has grown almost four inches. At that point the back head 42 is moved until it engages a temporary outboard stop 82. The outboard stop 82 is necessary to prevent the over-stretch of the blanket 30. The blanket cannot be allowed to grow a full four inches or the blanket will lose tension and rapidly fail. Thus if the back head 42 moved a full four inches between the inboard back stop 64 and the outboard back stop 68 the blanket 30 would be over-tensioned. Thus the temporary outboard stop 82 prevents the back head from moving completely against the outboard stop 68. As illustrated in FIG. 3 the temporary outboard stop 82 positions the back head 42 approximately one-half inch from the outboard stop 68. Similarly a temporary stop (not shown) is positioned to hold the front head 38 one-half inch from the front outboard stop 66.

As shown in FIG. 1 a plunger 84 is mounted to the back head 42 and a bracket 86 is mounted to the journal 18 of the cross beam 26. A sliding arm 88 is mounted in the bracket 86 which engages the plunger 84 to form the temporary stop 82. The sliding arm 88 is held in position by pin 90. As shown in FIG. 3, when the blanket 30 has grown by just less than seven inches, pin 90 is removed and the arms 88 are moved away from the shoe thereby removing the arms 88 from the path of the plungers 84 and allowing the back and front heads 38, 42 to move to the outboard stops 66, 68.

After the blanket has grown in cross machine direction by almost eight inches the machine 20 is shut down and slightly less than eight inches are trimmed from the blanket and the process is repeated.

It should be understood that the end of the blanket which is allowed to float can be maintained under tension either by internal air pressure or by the hydraulic pistons acting on the free head, although preferably a combination of both air pressure and hydraulic pressure in the pistons loading the free head are used.

It should be understood that the number of days between reversing the hydraulic systems controlling which head is held fixed and which is allowed to float will depend on the rate of growth of the blanket in the machine direction and other factors and could be significantly different from the fourteen-day cycle illustrated in FIG. 3.

Furthermore, although the inboard and outboard stops have been illustrated as being mounted on the journals, other means for limiting the inboard and outboard travel of the head may be employed, for example, making the stops integral to the hydraulic pistons.

It is understood that the invention is not limited to the particular construction and arrangement of parts herein illustrated and described, but embraces such modified forms thereof as come within the scope of the following claims.

I claim:

1. A method of increasing the life of a closed, endless loop type blanket employed in an extended pressing nip used in a papermaking machine, the pressing nip having a backing roll and a shoe with a concave surface which is urged against the backing roll, and wherein the first and second ends of the blanket are sealed to first and second heads, and wherein the press has a first inboard stop and a first outboard stop for positioning the first head, the press also having a second inboard stop and a second outboard stop for positioning the second head, the method comprising the steps of:

positioning the first head against the first inboard stop and allowing the second head to float free from being biased against the second inboard or outboard stop for a first selected period of time the second head moving freely, while at the same time, a constant load is supplied that maintains a fixed level of tension to the blanket;

after the first selected period of time, positioning the second head against the second inboard stop and allowing the first head to float free from being biased against the first inboard or outboard stop for a second selected period of time the first head moving freely, while at the same time, a constant load is supplied that maintains a fixed level of tension to the blanket; and repeating the two previous steps at least once.

2. The method claim 1, further comprising the step of:

positioning the first head against an intermediate stop positioned between the inboard stop and the outboard stop, and allowing the second head to float free from engagement by a stop for a selected period of time.

3. The method claim 1, further comprising the step of:

repeating after the two previous steps, at least once positioning the first head at the first outboard stop, and allowing the second head to float free from engagement by a stop for a third selected period of time.

* * * * *